United States Patent [19]

Hipp, Jr.

[11] 4,251,001

[45] Feb. 17, 1981

[54] DEVELOPER POWDER SUPPLY CARTRIDGE

[75] Inventor: Richard D. Hipp, Jr., Rushseba Township, Chisago County, Minn.

[73] Assignee: Minnesota Mining and Manufacturing Company, St. Paul, Minn.

[21] Appl. No.: 86,933

[22] Filed: Oct. 22, 1979

[51] Int. Cl.[3] ..... B65D 83/06

[52] U.S. Cl. ..... 215/237; 206/216; 215/1 C; 232/43.1

[58] Field of Search ..... 215/1 C, 232, 237; 206/216; 232/43.1

[56] References Cited

U.S. PATENT DOCUMENTS

| | | | |
|---|---|---|---|
| 1,959,790 | 5/1934 | Katzman | 232/43.1 X |
| 3,380,608 | 4/1968 | Morbeck | 215/1 C |
| 3,618,826 | 11/1971 | Kangas | 206/633 X |
| 3,999,654 | 12/1976 | Pollack | 206/216 |

*Primary Examiner*—Donald F. Norton

*Attorney, Agent, or Firm*—Cruzan Alexander; Donald M. Sell; John C. Barnes

[57] ABSTRACT

A toner supply cartridge for use with an electrographic reproduction machine, having a generally symmetric configuration with a centrally located filling opening. The cartridge contains a second larger opening for dispensing the toner into the copy machine, this opening being sealed prior to use with a permanently attached door. The door is openable after inserting the cartridge into the reproduction machine by pulling an external tab structure which is connected to a section of adhesive tape securing the door in its closed position. This structure minimizes the amount of toner unintentionally escaping from the toner cartridge prior and during its insertion into the reproduction machine.

7 Claims, 3 Drawing Figures

DEVELOPER POWDER SUPPLY CARTRIDGE

BACKGROUND OF THE INVENTION

This invention relates to a cartridge for supplying developer powder for use in an electrographic reproduction machine.

In machines employing electrogaphic reproduction techniques developer powder is used to form the darkened image of the information being reproduced. This developer powder consists of microscopic toner particles which through various techniques, as for example, electrostatic charging, can be influenced to attach themselves to a photoconductive surface. This photoconductive surface is then further processed to result in a finished copy. The supply of developer powder or toner is consumed as these particles are utilized in the electrographic reproduction process and hence must be replenished. This replenishing can be very problematic due to the microscopic size and tendency of the toner to become electrostatically charged. It is quite common with the conventional toner supply cartridges to have toner escape during the replenishing process and soil the adjacent areas of the machine as well as the operator and the surrounding office environment. One attempt to solve this problem is disclosed in U.S. Pat. No. 3,999,654, issued to M. A. Pollack. This patent discloses a cartridge for dispensing the toner into the copy machine, in which the opening used for dispensing is closed off by an adhesive tape affixed directly to the wall portions of the cartridge. The adhesive tape terminates in a tab portion which can be pulled after the cartridge has been inserted into the copy machine to release the developer powder. Although the device described by Pollack diminishes the amount of developer powder escaping from the cartridge during its intended release, it still relies strictly on an adhesive tape seal in forming the closure. Since the adhesive surface of the tape is directly exposed to the toner particles, it transports a layer of toner particles which have adhered to its adhesive surface, when it is removed. This toner covered tape is difficult to handle without further soiling the machine or its operator. This type of seal is also inherently prone to release as, for example, due to external mechanical stresses being applied against the surface of the adhesive tape during shipment or handling, causing it to slip or release its contact with the container, resulting in the developer powder escaping from the container.

There is an additional problem with this type of container during the initial toner filling operations. If the same opening is used for dispensing the toner particles, as well as filling the cartridge, the opening must be of an adequate size to afford the dispensing of all of the toner particles within the cartridge. In order to use this cartridge in an automatic filling operation the entire excess of this larger than required filling opening would have to be closed off to prevent the toner particles from escaping during the filling operation. This necessitates greater complexity of the device used to orient the cartridge within the filling machine as well as increased complexity within the filling machine itself.

Similarly, if a second smaller opening for filling the cartridge is provided but is not centrally located, or if the cartridge lacks symmetry with respect to the opening, greater complexity in the machine and its associated handling equipment will result.

SUMMARY OF THE INVENTION

The developer powder cartridge of the present invention provides a cartridge which can be inserted into a copy machine prior to opening the cartridge so as to release the toner, wherein the opening dispensing the powder is closed by a rigid non-adhesive member permanently attached to the cartridge and not as vulnerable to being opened by mechanical stresses as adhesive tape, wherein the rigid member can be externally opened after the cartridge has been inserted into the copy machine, and wherein a second smaller opening is provided which is centrally disposed and formed within a symmetrical container to lend the cartridge to automatic filling operations.

This novel developer powder cartridge comprises a two-part bottle-like container wherein the first part is formed of side portions and end portions defining a trough and wherein one of the end portions has a longitudinally extending semi-cylindrical spout. The second part is similarly formed to have side portions and end portions also defining a trough and also having a longitudinally extending semi-cylindrical spout. In addition, this second part has a side portion through which a rectangular opening extends longitudinally over a substantial portion of its area. The first part and the second part are designed to be mated together along their open portions so as to define a multi-sided bottle-like container having a generally cylindrical spout projecting from one of its ends. An elongated rectangular door is hingedly mounted to the side portion of the cartridge containing the opening. This door is disposed to interpose and close the above-described opening. The door is held in its closed position by securing means affixed between the door and the side portion of the cartridge.

Connecting means for removing the securing means are provided such that the cartridge can be inserted into the copy machine prior to opening the cartridge or otherwise releasing the toner. Once the cartridge is within the copy machine the connecting means for removing the securing means can be utilized to release the toner. It should be emphasized that neither the securing means or the connecting means come into contact with the toner and thus are clean when removed. The only element of the cartridge contacting the toner is the hinged door which remains connected to the cartridge. In this manner the amount of toner accidentally released either as part of the replenishing process or due to failure of the seal providing the closure during handling of the cartridge is diminished.

It is also an important aspect of this invention that the intersection of the side portions defining the exterior of the cartridge are of an equal distance from the cartridge's longitudinal axis as well as the centrally located spout. This positioning of the spout and the cartridge's exterior permit the cartridge to be easily oriented and placed within conventional automatic filling equipment so as to afford the automatic filling of the cartridge with toner.

DESCRIPTION OF THE ACCOMPANYING DRAWING

The present invention will be further described hereinafter with reference to the accompanying drawing wherein.

DETAILED DESCRIPTION OF THE PREFERRED EMBODIMENT

Figure 1:
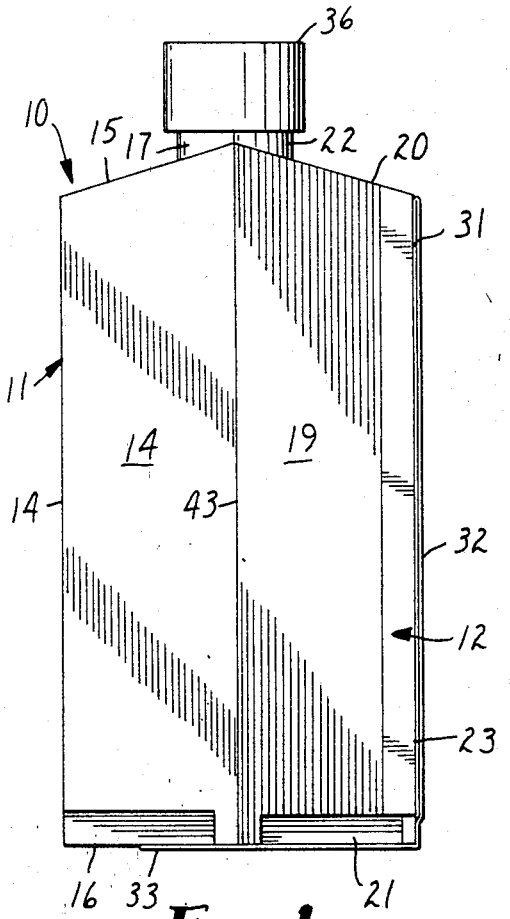
FIG. 1 is a front view of the cartridge according to the present invention.

The developer powder supply cartridge 10 of the present invention comprises a two-part bottle-like container molded of a polymeric material wherein the first part 11 is formed to have three side portions 14 and two ends portions 15 and 16 defining a trough having a generally trapezoidal cross section and wherein a first 15 of said end portions 15 and 16 has a longitudinally extending semi-cylindrical spout 17.

Figure 3:
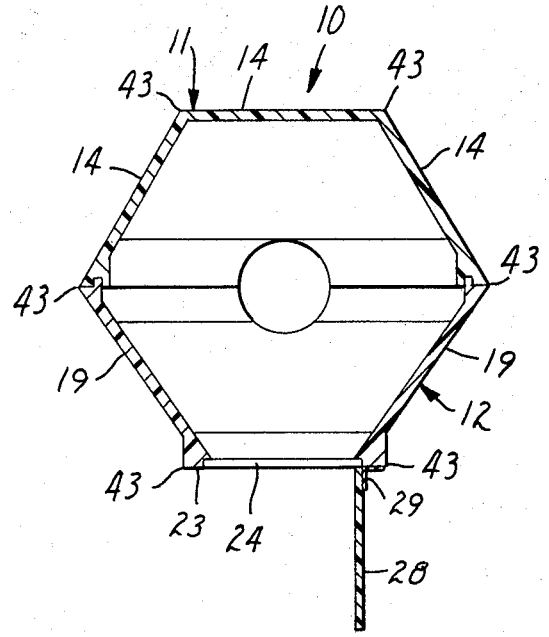
FIG. 3 is a sectional view of the cartridge according to FIG. 2 taken along line 3—3', and showing the dispenser door in its open position.

The second part 12 is similarly formed to have two side portions 19 joined by a third side portion 23 and two end portions 20 and 21 likewise defining a trough having a generally trapezoidal cross-section, and wherein a first 20 of said end portions 20 and 21 has a longitudinally extending semi-cylindrical spout 22. In this second part 12 the side portion 23 has a rectangular opening 24 extending longitudinally over a substantial portion of its area. The first and second parts 11 and 12 are designed to have mating tongue and groove opposed edges along their open portions so as to define a multi-sided bottle-like container having a hexagonal cross-section and having a centrally located (see FIGS. 2, 3) and generally cylindrical spout 26 projecting from the first end portions 15 and 20.

This cylindrical spout 26 is formed to have external threads 37 on its periphery upon which a cap 36 with internal threads can be fastened to close its opening.

An elongated rectangular door 28 is hingedly mounted along one of the edges of side portion 23 of the cartridge 10. This mounting is achieved by affixing a couple of pieces of adhesive tape 29 between the door 28 and the side portion 23 along this edge (see FIG. 3). The door is further disposed to be able to intromit and thereby close the above-described opening 24 in the second part 12 of the cartridge 10. The door 28 can be held in this closed position by securing means which comprise a strip of adhesive tape 31 having a length and a width slightly exceeding the length and the width of the rectangular opening of the cartridge, affixed to the door and extending beyond the door 28 and onto the side portion 23 of the cartridge 10, so as to be affixed across the door 28 and onto the cartridge 10, thus securing the door 28 in its closed position to the cartridge 10.

Figure 2:
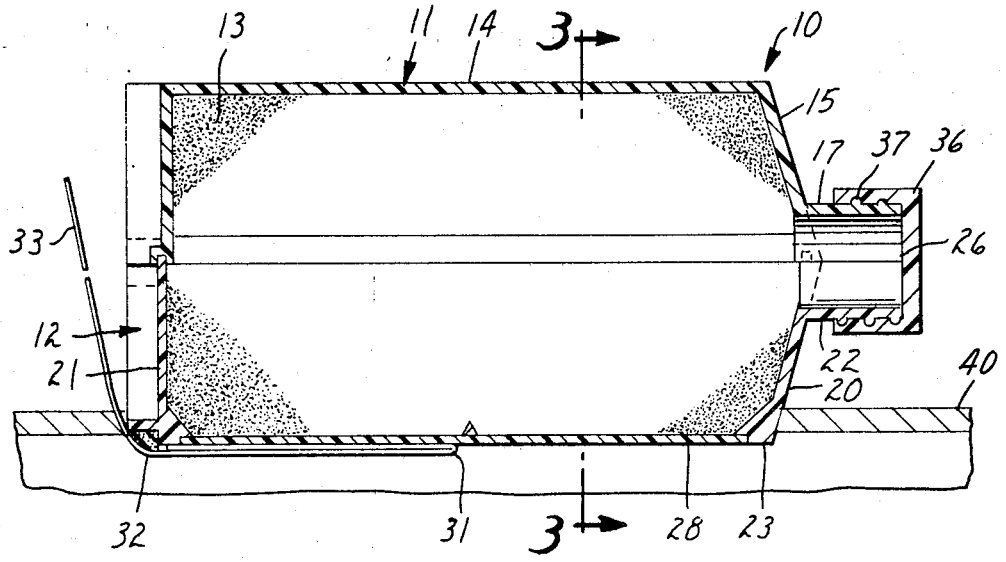
FIG. 2 is a side view of the cartridge according to FIG. 1.

The connecting means for removing the securing means comprises a nonadhesive strip of material 32 connected to the adhesive tape 31 as it terminates on the first end 20 of the cartridge 10. In practice, this nonadhesive connecting strip 32 can simply be a continuation of the backing material utilized in constructing the adhesive tape 31 but which is not coated with adhesive. The connecting strip 32 doubles back upon and adjacent the adhesive tape 31 until it reaches the second end 21 of the cartridge 10. The connecting strip 32 is brought around the intersection of the cartridge 10 between the second end 21 and the side 23 containing the door 28. The connecting strip 32 continues along a portion of the second end 21 until it terminates and is fastened to the cartridge 10 by a small piece of adhesive tape (not shown) approximately midway along the first part 11 between the mating line and the intersection between the first 11 and the second parts 12. The portion of the connecting strip 32 running adjacent to the second end 21 is a tab portion 33 which can be pulled to remove the adhesive tape 31 as shown in FIG. 2. When the adhesive tape 31 is completely removed, the door 28 is free to fall open under the weight of the toner 13 so as to dispense the toner 13 into the electrographic reproduction machine 40.

It is also an important aspect of this invention that the intersection 43 between the side portions 14, 19, and 23 defining the cartridge's exterior are of an equal distance from the longitudinal axis of the cartridge 10 as well as of an equal distance from the spout 26 (being likewise centrally disposed with respect to the longitudinal axis). This positioning of the spout 26 with respect to the cartridge's exterior permit the cartridge 10 to be easily located and oriented within conventional automatic filling equipment to afford the automatic filling of the cartridge 10 with toner 13.

Having thus described a preferred embodiment of the present invention it will be understood that changes may be made in size, shape or configuration of some of the parts without departing from the present invention as described in the appended claims.

What is claimed is:

1. A novel developer powder supply cartridge for use in a copy machine comprising a first part having a plurality of side portions and two end portions defining a trough wherein a first of said end portions has a longitudinally extending semicylindrical spout, a second part having a plurality of side portions and two end portions defining a trough wherein a first of said end portions has a longitudinally extending semicylindrical spout, and wherein one of the side portions has a rectangular opening extending longitudinally over a substantial portion of its area, and wherein said first part and said second part are mated along their open sides to define a multisided bottle-like container having a centrally located and generally cylindrical longitudinally extending spout portion projecting from said first end of said container to afford the filling of said container with developer powder, an elongated rectangular door hingedly mounted to said container and disposed to intromit and close the rectangular opening in said second part when said door is in a closed position, means for securing said door in its closed position to said second part so as to prevent the unintentional escape of developer powder through the rectangular opening, connecting means for removing said securing means after the insertion of said container into a copy machine so as to afford the dispensing of said developer powder into the copy machine, and means for capping said spout.

2. A cartridge as claimed in claim 1 wherein said door is hingedly mounted to said cartridge with at least one section of adhesive tape affixed between said cartridge and said door.

3. A cartridge as claimed in claim 1 wherein said means for securing said door in its closed position comprises a strip of adhesive tape having a length and width slightly exceeding the length and width of said rectangular opening of said cartridge, affixed to said door and extending beyond said door onto said side portion of said cartridge so as to be affixed across said door and onto said cartridge, thus securing said door in its closed position to said cartridge.

4. A cartridge as claimed in claim 1 wherein said connecting means for removing said securing means comprises a nonadhesive strip of material connected to said securing means as its terminates on the first end of said cartridge, said connecting strip then doubling back upon and adjacent to said adhesive tape until it reaches the second end of said cartridge, said connecting strip continuing around the intersection between second end and the side of said cartridge containing said door, said connecting strip continuing along a portion of said second end until it terminates and is fastened to said cartridge wherein the portion of said connecting strip located adjacent the second end of said container affords a tab portion which can be pulled to remove said adhesive tape.

5. A cartridge as claimed in claim 1 wherein said container has a generally hexagonal cross section with the intersection of its longitudinal sides being equal distance from said spout.

6. A cartridge as claimed in claim 1 wherein said container is molded of a polymeric material and wherein said container comprises two generally symmetric half sections affording ease of molding, said sections being mated together forming said container.

7. A cartridge as claimed in claim 1 wherein said means for capping said cartridge comprises an external thread around the periphery of said spout, and a cap having an internal thread disposed so as to mate with said external thread of said spout.

* * * * *